US008057319B2

(12) United States Patent
Herbert

(10) Patent No.: US 8,057,319 B2
(45) Date of Patent: Nov. 15, 2011

(54) TRAINING BALLS FOR POOL

(76) Inventor: William S. Herbert, San Antonio, TX (US)

( * ) Notice: Subject to any disclaimer, the term of this patent is extended or adjusted under 35 U.S.C. 154(b) by 0 days.

(21) Appl. No.: 12/426,735

(22) Filed: Apr. 20, 2009

(65) Prior Publication Data

US 2009/0264212 A1 Oct. 22, 2009

Related U.S. Application Data

(60) Provisional application No. 61/124,593, filed on Apr. 18, 2008.

(51) Int. Cl.
*A63D 15/00* (2006.01)
*A63B 37/00* (2006.01)

(52) U.S. Cl. ..... 473/2; 473/52

(58) Field of Classification Search ..... 473/2, 52; 40/327; D21/713
See application file for complete search history.

(56) References Cited

U.S. PATENT DOCUMENTS 652,993 A * 7/1900 Burt ..... 40/327
906,932 A * 12/1908 Riblet ..... 40/327
1,418,220 A * 5/1922 White ..... 473/384
2,861,810 A * 11/1958 Veatch ..... 473/353
3,819,190 A * 6/1974 Nepela et al. ..... 473/383
3,993,305 A * 11/1976 Nicholson ..... 473/2
5,322,475 A * 6/1994 Irvin ..... 473/52
5,338,039 A * 8/1994 Oka et al. ..... 473/384
5,401,215 A * 3/1995 Pfost ..... 473/2
5,536,013 A * 7/1996 Pocklington ..... 473/384
5,662,530 A * 9/1997 Sellar ..... 473/268
D393,672 S * 4/1998 Clay ..... D21/713
5,842,937 A * 12/1998 Dalton et al. ..... 473/384
6,117,031 A * 9/2000 Malinauskas et al. ..... 473/570
6,162,136 A * 12/2000 Aoyama ..... 473/383
6,290,615 B1 * 9/2001 Ogg ..... 473/378
6,364,783 B1 * 4/2002 Kellogg et al. ..... 473/2
6,866,590 B2 * 3/2005 Tucker ..... 473/2
2009/0264212 A1 * 10/2009 Herbert ..... 473/2

* cited by examiner

*Primary Examiner* — Mitra Aryanpour
(74) *Attorney, Agent, or Firm* — Italia IP; James A. Italia

(57) ABSTRACT

A training ball for pool type games. The training ball may comprise an array of visually coded bounded shapes disposed on the spherical exterior surface, wherein each one visually coded bounded shape has a characteristic visual coding such as color, and a diametrically opposed corresponding visually coded bounded shape having substantially identical characteristic visual coding, and wherein the array covers substantially all of the spherical exterior surface of the solid sphere. All of the visually coded bounded shapes display characteristic visual coding which is easily visually discernible from each adjacent one of the visually coded bounded shapes. In an associated method of play or practice, a player may visually hypothesize a straight line passing through the center of the training ball using the opposed similar visually coded bounded shapes, mentally set up a shot, and then execute that shot.

4 Claims, 3 Drawing Sheets

TRAINING BALLS FOR POOL

CROSS-REFERENCE TO RELATED APPLICATIONS

This application claims the benefit of the filing date under 35 USC 119(e) of the filing date of U.S. Provisional Application Ser. No. 61/124,593, filed Apr. 18, 2008, the contents of which are incorporated herein by reference. Apr. 18, 2009 fell on a Saturday.

FIELD OF THE INVENTION

The present invention relates to games such as pool, billiards, snooker, and the like. More particularly, the invention provides balls such as cue balls and object balls which are adapted to enable learners to build their skills in aiming and shooting.

BACKGROUND OF THE INVENTION

Pool type games are games of skill which require players to project where one ball will strike another ball, in order to propel the latter to a desired location on the playing surface. The desired location may be a pocket of a pool table, for example, or may be another ball, such as an object ball of a carom billiard type game. Pool type games demand great precision in striking a ball in exactly the right location and at an appropriate angle so as to propel the ball in a direction which will have the intended result.

One aspect of understanding the effect of specific ball trajectories is identifying exactly where one ball must strike the next ball. A common intuitive approach is to plan each shot around the center of the balls. This approach is actually correct only when balls and targets are arranged in a straight line. Any deviation from the straight line situation, which is actually infrequent in actual play, requires an adjustment in planning shots.

That is, the player must account for one point on the surface of one ball contacting a particular point on the surface of the struck ball. This differs from the center-to-center intuitive approach described above in that angled shots, or those which are misaligned as that refers to the infrequent straight line alignment, in that the player must account for the radius of each ball as the geometric centers of the respective balls are displaced from the outer surface of each ball by a magnitude equal to the radius of the respective balls.

This skill comes intuitively to some, and in others may develop with practice and be subconsciously acquired. It is very discouraging to those who have recently taken up pool type games should this skill not be intuitive, or should the skill develop slowly.

There exists a need to expedite this skill in developing players.

SUMMARY OF THE INVENTION

The present invention answers the above need by providing apparatus which promotes the skill of accurately setting up shots in pool type games by accounting for the discrepancy between center-to-center visualization of proposed shots and the actual situation which occurs. In the present invention, a novel training ball may have visually discernible patches disposed over the outer surface thereof in an array covering the entire surface of the training ball. These patches are provided in diametrically opposed pairs. Each patch, which may be for example a recognizable geometric shape such as a pentagon or a hexagon, is visually distinguishable from adjacent patches, such as by color coding. Each patch is colored or otherwise visually coded identically to its diametrically opposed corresponding member of the pair. In this manner, a straight line passing through the center of the training ball may be visualized by a player or student of the game. The straight line is utilized to visualize or plan subsequent shots.

At least three consequences arise from the novel arrangement. One is that a player may more accurately visualize a true diametric line through the ball, as opposed to mentally laying out a diametric line which, in the absence of the paired coded patches, may have no discernible end points at the surface of the ball.

The second consequence is that focusing on visual elements such as the patches intuitively focuses the player's attention on the surface of the ball rather than passively allowing the player to establish the misleading practice of visualizing center-to-center relationships between balls.

A third consequence is that the player's attention is drawn to a relatively small, readily discerned area on a ball which is to be struck in the course of play or practice, rather than on the entirety of the ball or on the center of the ball.

With appropriate focus on actual locations of impact, and with more precise alignment tools when visualizing alignment of balls and their intended trajectories after being struck, players and students practicing games may more expeditiously assimilate principles of accurate and effective play.

It is therefore an object of the invention to provide balls which promote improvement of skills in choosing, determining, and executing shots in continuous practice and play.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

The present invention contemplates a training ball for use in pool type games wherein at least one playing ball is placed on a generally horizontal playing surface and is struck by a player in order to propel the playing ball to a desired location relative to the generally horizontal playing surface. The playing ball may be a cue ball, an object ball, a plurality of object balls, or a plurality of playing balls including a cue ball and one or more object balls. Pool type games which may be played using the novel training balls, such as the training ball 100 of FIG. 1, include billiards, pool, snooker, other known games in which a ball is placed on a playing surface and is struck by a cue stick or the like, practice routines for enhancing skills in playing any of these games, games and practice routines modified from known games such as those which combine elements from more than one of the known games, and new games and practice routines which utilize the principles of the known games.

Figure 1:
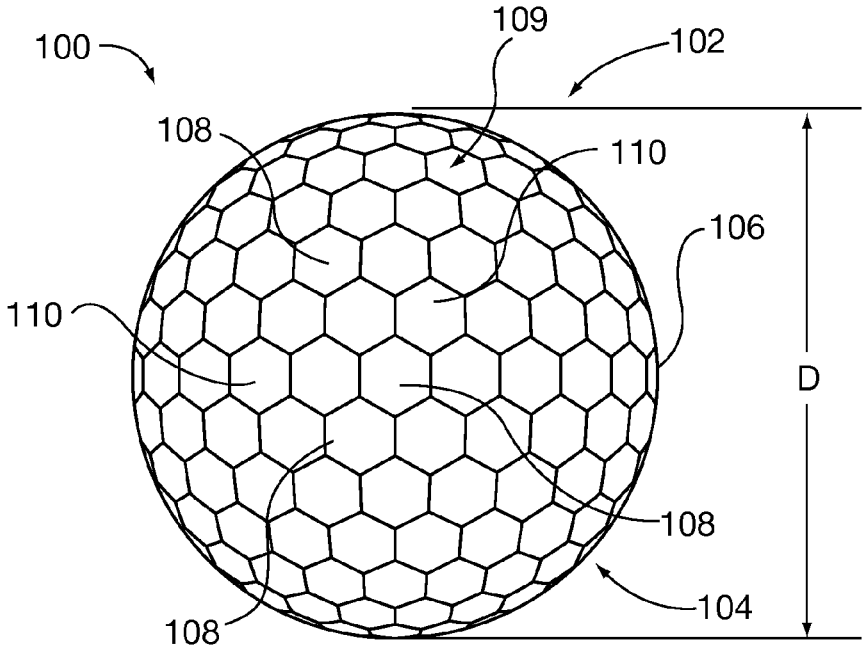
FIG. 1 is an abbreviated front elevational view of a training ball according to at least one aspect of the invention.
Figure 2:
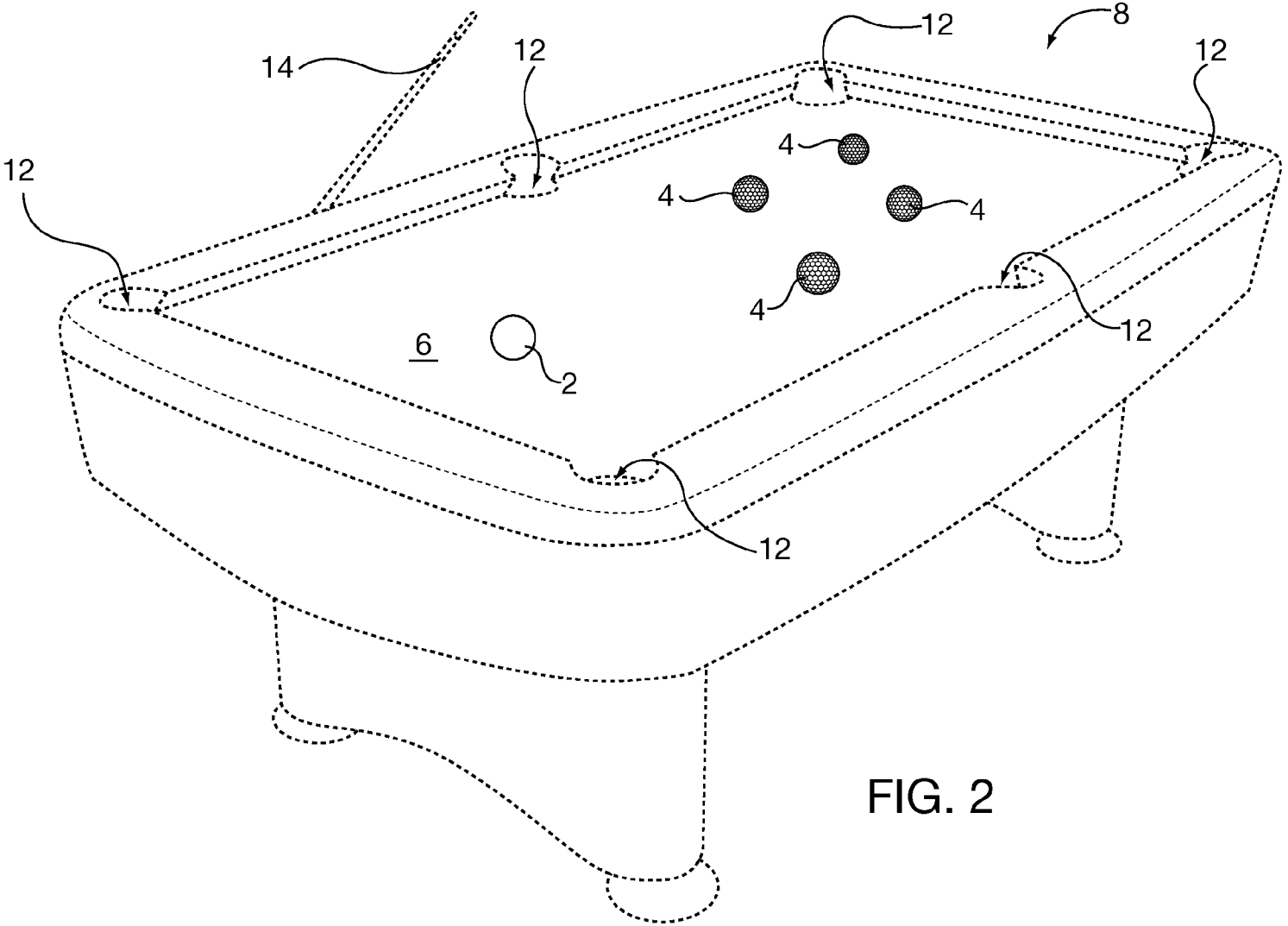
FIG. 2 is an environmental perspective view of a pool table and pool playing balls which may be configured according to at least one aspect of the invention.

Referring now to FIGS. 1 and 2, the training ball 100 comprises a solid sphere characteristic of balls generally. Solidity signifies that for practical purposes, the training ball 100 remains substantially spherical at all times. As employed herein, "substantially spherical" is to be interpreted as maintaining configuration sufficiently to enable the subject game to be played as intended, and will be equal to rigidity and form holding of conventional pool type cue and object balls. The requisite degree of rigidity and form holding will accommodate a hollow center or other internal voids (none shown), provided that neither the internal voids nor the constituent material of the training ball will cause deformation from the overall spherical configuration beyond that described above as acceptable.

The training ball 100 has alignment indicia 102 placed on the exterior thereof for enabling a player (not shown) to visualize relationship of the training ball 100 to another playing ball such as a cue ball 2, to one or more of object balls 4 shown placed on the playing surface 6 of a pool table 8, or a combination of the cue ball 2 and one or more of the object balls 4. The pool table 8 may be conventional, having a short upwardly projecting wall 10 and pockets 12 into which the training ball 100, the cue ball 2, and the object balls 4 may fall.

The cue ball 2, any one or more of the object balls 4, or a combination of both the cue ball 2 and any one or more of the object balls 4 may be configured as a training ball, such as the training ball 100.

As seen in FIG. 1, the visually coded bounded shapes 108, 110 are of dimensions such that the diameter D of the training ball 100 is at least five times as great as the diameter of each of the visually coded bounded shapes 108, 110.

The training ball 100 may comprise a solid sphere 104 displaying diameter D equal to that of at least one of the cue ball 2 and an object ball 4. The solid sphere 104 may comprise a spherical exterior surface 106. The alignment indicia 102 may comprise an array 109 of visually coded bounded shapes 108, 110 disposed on the spherical exterior surface 106. The array 109, although shown in abbreviated form in FIG. 1, may cover substantially all of the spherical exterior surface 106. This characteristic enables alignment, described hereinafter, to be performed regardless of the position of the training ball 100 as it sits on the playing surface 6.

The visually coded bounded shapes 108 may be hexagons, while the visually coded bounded shapes 110 may be pentagons, for example. The exact nature of the visually coded bounded shapes, such as the visually coded bounded shapes 108, 110 is not critical. For best visual clarity and for ready identification of any one visually coded bounded shape, each one of the visually coded bounded shapes may comprise a perimeter having configuration of a regular geometric figure such as the pentagon of the visually coded bounded shapes 108 and the hexagons of the visually coded bounded shapes 110. The regular geometric figures may comprise straight line segments, as is typical of pentagons and hexagons, but this is not critical. The visually coded bounded shapes may also contact at least one adjacent visually coded bounded shape. Alternatively, adjacent visually coded bounded shapes may be separated from one another such that they are not in actual contact (this option is not shown).

Figure 3:
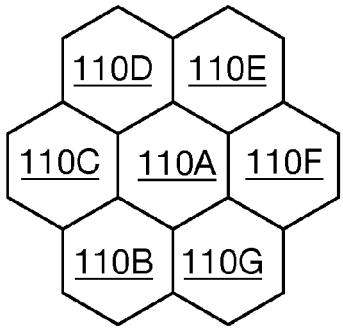
FIG. 3 is a diagrammatic detail view showing an identification scheme for identifying different regions of a training ball such as the training ball of FIG. 1.

Each one of the visually coded bounded shapes 108, 110 has a characteristic visual coding, which may be for example a color or hue. This is shown in FIG. 3, wherein each of the visually coded bounded shapes 110B, 110C, 110D, 110E, 110F, and 110G which is adjacent to the visually coded bounded shape 110A is of a color or hue which is different from that of the central visually coded bounded shape 110. The array 109 is so arranged that any one visually coded bounded shape, such as the visually coded bounded shapes 108, 110, will always be neighbored by other visually coded bounded shapes 108, 110 of different color or hue.

Figure 4:
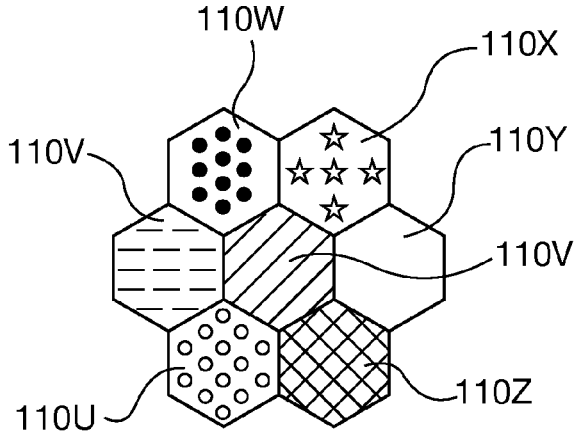
FIG. 4 is a diagrammatic detail view showing an alternative to the identification scheme of FIG. 3.

Alternatively, the characteristic visual coding may be based on characteristics other than color or hue. This is illustrated in FIG. 4, wherein geometric patterns are imposed on each one of the visually coded bounded shapes 110U, 110V, 110W, 110X, and 110Z, with the visually coded bounded shape 110Y being devoid of geometric patterns. It is not necessary to have geometric patterns, colors, or other discernible marking on each one of the visually coded bounded shapes. It is merely necessary to differentiate each one visually coded bounded shape from neighboring visually coded bounded shapes by characteristic visual coding which is easily visually discernible from each adjacent one of the visually coded bounded shapes.

The visually coded bounded shapes may be identical to one another, or alternatively may differ in dimensions and configurations such as parametric configurations. An example of the latter is the array 109 of FIG. 1, which is seen to comprise both pentagons and also hexagons.

The visually coded bounded shapes, such as the visually coded bounded shapes 108, 110 are not randomly dispersed over the spherical exterior 106. In addition to being arranged so as not to have two similar colorings or other characteristic visual coding occur in adjacent visually coded bounded shapes, each one visually coded bounded shape has a diametrically opposed corresponding visually coded bounded shape having substantially identical characteristic visual coding located on the opposite side of the training ball 100.

Figure 5:
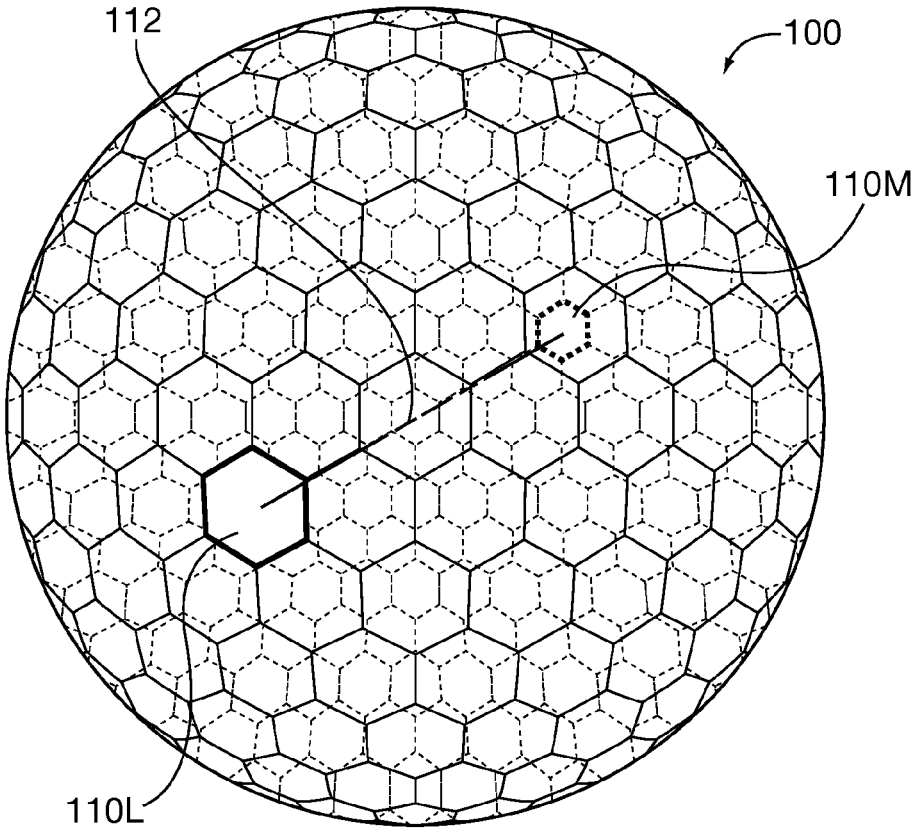
FIG. 5 is a diagrammatic perspective view of a training ball according to at least one aspect of the invention, emphasizing opposed regions of the training ball.

Referring also to FIG. 5, this characteristic enables a player to visually hypothesize a straight line 112 passing through the center of the training ball 100 by observing one side of the training ball 100 and also the other opposed side of the training ball 100, and identifying opposed generally identical visually coded bounded shapes such as the hexagonal visually coded bounded shapes 110L and 110M disposed on the training ball 100. The hypothesized straight line 112 may be used by a player to visualize the point of impact of the training ball 100 with another playing ball such as the cue ball 2 or an object ball 4, based on using the hypothesized straight line 112.

As employed herein, the terms "visualizing" and "hypothesizing" and their variants are essentially interchangeable, and connote any mental process for accomplishing the stated function or goal.

Figure 6:
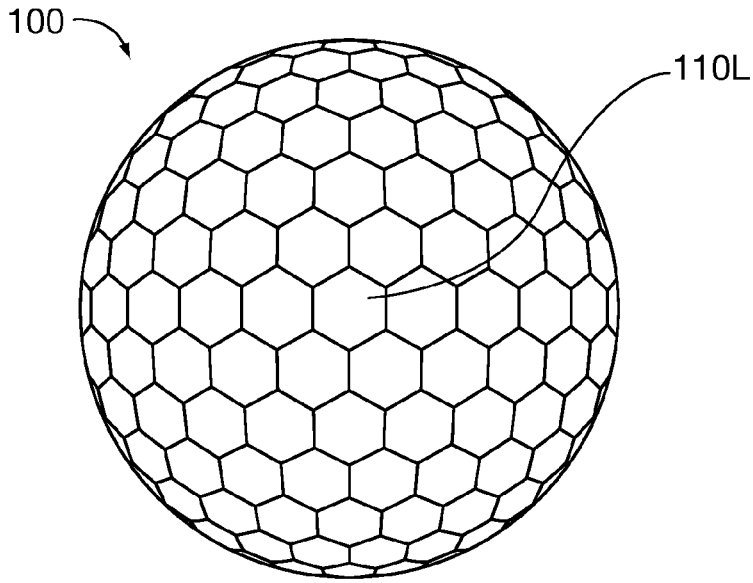
FIG. 6 is a perspective view of a training ball such as the training ball of FIG. 1.

When viewing one side of the ball 100, the player aligns the playing ball to be struck with another playing ball, and directly views the playing ball to be struck directly. The playing ball to be viewed, such as the training ball 100, will appear as shown in FIG. 6. It will be noticed in FIG. 6 that the visually coded bounded shape 110L which most directly faces the observer appears to be larger than neighboring or adjacent visually coded bounded shapes. This is due to parallax effects which occur with balls of the size of balls of pool type games. The appropriate visually coded bounded shape may thus be identified. The corresponding visually coded bounded shape 110M may be identified by observing the opposed side of the ball and determining that visually coded bounded shape of the same visual coding, such as color or geometric pattern. The hypothesized straight line 112 may then be visualized. The straight line 112 may be utilized to visualize a proposed point of contact of the training ball 100 with another playing ball which has been placed on the generally horizontal playing surface 6 when the player strikes the training ball 100 with a cue stick such as the cue stick 14 shown in FIG. 2. Alignments and proposed points of contact between any two playing balls configured as the training ball 100 may similarly be determined.

The invention may be viewed as a training ball such as the training ball 100. It may also be viewed as a set of playing balls for use in pool type games, such as the set including the cue ball 2 and the object balls 4. The number of balls may be any number of balls. Similarly, any one or combination of these balls may be configured as a training ball such as the training ball 100. One specific option includes having the cue ball, such as the cue ball 2, being configured as or having characteristics of a training ball such as the training ball 100, regardless of whether other balls are also configured as a training ball. A second option is one wherein at least one object ball, such as the object balls 4, has characteristics of the training ball. In a third option, both a cue ball such as the cue ball 2 and at least one object ball such as the object balls 4 may have characteristics of the training ball.

The cue ball and the object balls may all have visual characteristics which enable an observer to visually discern the object balls as members of a group which is visually discernible from the cue ball and also as peers of the group. That is, object balls may be visually discernible as being object balls rather than being a cue ball. This may be achieved in several ways. For example, to most resemble conventional balls of pool type games, individual balls may have borders between adjacent visually coded bounded shapes which borders are white for a cue ball and black for object balls. Another way of distinguishing the cue ball from object balls could be to use colored visually coded bounded shapes for object balls and geometrically patterned visually coded bounded shapes for the cue ball. Any suitable graphic effect may be utilized to identify object balls collectively as members or peers of one group and the cue ball as not a member of the group.

The invention may also be viewed as a method of using a training ball such as the training ball 100 to plan shots in pool type games and practice sessions of the type wherein at least one playing ball is placed on a generally horizontal playing surface and is struck in order to propel the playing ball to a desired location relative to the generally horizontal playing surface. The method may comprise a step of providing a plurality of playing balls including a cue ball such as the cue ball 2 and at least one object ball such as the object balls 4, wherein one of the cue ball and the at least one object ball is configured as a training ball such as the training ball 100.

The method may comprise a step of hypothesizing a straight line passing through the center of the training ball, such as the straight line 112, by observing one side of the training ball and also the other side of the training ball and identifying opposed generally identical visually coded bounded shapes disposed on the training ball, such as the visually coded bounded shapes 110L and 110M.

The method may comprise a step of visualizing a proposed point of contact with at least one of the cue ball and the object balls placed on the generally horizontal playing surface.

The method may comprise a step of visualizing the point of impact of the training ball with another playing ball based on using the hypothesized straight line.

The method may comprise a step of striking the training ball according to the visualized point of impact.

In the method steps recited above, the step of providing a plurality of playing balls comprises a further step of providing a cue ball configured as the training ball.

In the method steps recited above, the step of providing a plurality of playing balls comprises a further step of providing an object ball configured as the training ball.

Of course, both of the last two steps may be practiced together.

The present invention is susceptible to modifications and variations which may be introduced thereto without departing from the inventive concepts.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A method of playing pool type games with a set of playing balls including a cue ball and at least one object ball, at least one of the cue ball and the at least one object ball is configured as a training ball, the training ball including a solid sphere including a diameter substantially equal to a diameter of at least one of a cue ball and an object ball, a spherical exterior surface, and an array including a plurality of visually coded bounded shapes disposed on the spherical exterior surface, each visually coded bounded shape including a characteristic visual coding and located adjacent another visually coded bounded shape, the array including a diametrically opposed corresponding visually coded bounded shape having substantially identical characteristic visual coding for each visually coded bounded shape, and wherein the array covers substantially all of the spherical exterior surface, and the characteristic visual coding of each visually coded bounded shape is easily visually discernible from adjacent visually coded bounded shapes, comprising:

providing a training ball comprising a solid sphere including a diameter substantially equal to a diameter of a cue ball or an object ball, and a spherical exterior surface, and an array including a plurality of visually coded bounded shapes disposed on the spherical exterior surface, each visually coded bounding shape including a characteristic visual coding and located adjacent another visually coded bounded shape, the array including a diametrically opposed corresponding visually coded bounded shape having substantially identical characteristic visual coding for each visually coded bounded shape, wherein the array covers substantially all of the spherical exterior surface, and the visually coded bounded shapes are of a geometric shape where each visually coded bounded shape has at least five sides;

hypothesizing a straight line passing through the center of the training ball by observing one side of the training ball and also the other side of the training ball and identifying opposed generally identical visually coded bounded shapes disposed on the training ball;

visualizing a proposed point of contact with at least one of the cue ball and the object balls placed on the generally horizontal playing surface;

visualizing the point of impact of the training ball with another playing ball based on using the hypothesized straight line; and striking the training ball placed on the generally horizontal playing surface with a cue stick according to the visualized point of impact.

2. The method of claim 1, wherein the cue ball is configured as a training ball.

3. The method of claim 1, wherein the at least one object ball is configured as a training ball.

4. The method of claim 1, wherein the cue ball is configured as a training ball and the at least one object ball is configured as a training ball.

* * * * *